US007665975B2

(12) United States Patent
Parmeter et al.

(10) Patent No.: US 7,665,975 B2
(45) Date of Patent: Feb. 23, 2010

(54) SEAL SECTION OIL SEAL FOR SUBMERSIBLE PUMP ASSEMBLY

(75) Inventors: Larry J. Parmeter, Broken Arrow, OK (US); Clarence F. Hall, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 419 days.

(21) Appl. No.: 11/312,624

(22) Filed: Dec. 20, 2005

(65) Prior Publication Data

US 2007/0140876 A1 Jun. 21, 2007

(51) Int. Cl.
*F04B 35/04* (2006.01)

(52) U.S. Cl. ..... 417/423.11

(58) Field of Classification Search ..... 417/423.11, 417/423.3, 414, 255; 310/87, 88; 277/24, 277/348–351, 563
See application file for complete search history.

(56) References Cited

U.S. PATENT DOCUMENTS

| | | | | | |
|---|---|---|---|---|---|
| 1,970,484 | A | * | 8/1934 | Arutunoff | 310/87 |
| 2,002,913 | A | * | 5/1935 | Mendenhall et al. | 310/87 |
| 2,020,513 | A | * | 11/1935 | Mendenhall et al. | 310/87 |
| 2,287,034 | A | * | 6/1942 | Hollander | 415/109 |
| 2,320,708 | A | * | 6/1943 | Yost | 417/423.11 |
| 2,404,783 | A | * | 7/1946 | Blom | 417/414 |
| 3,384,769 | A | * | 5/1968 | Schaefer et al. | 310/87 |
| 3,475,634 | A | * | 10/1969 | Pomezkova et al. | 310/87 |
| 3,502,919 | A | * | 3/1970 | Drake et al. | 310/87 |
| 3,671,786 | A | * | 6/1972 | Jones | 310/87 |
| 3,854,064 | A | * | 12/1974 | Dunbar | 310/87 |
| RE30,382 | E | * | 8/1980 | Mandell | 138/89 |
| 4,462,765 | A | * | 7/1984 | Rodkin et al. | 417/414 |
| 4,491,331 | A | | 1/1985 | Salant et al. | |
| 4,966,532 | A | * | 10/1990 | Fengsheng | 417/366 |
| 4,992,689 | A | | 2/1991 | Bookout | |
| 5,367,214 | A | * | 11/1994 | Turner, Jr. | 310/87 |
| 5,404,061 | A | * | 4/1995 | Parmeter | 310/87 |
| 5,796,197 | A | * | 8/1998 | Bookout | 310/85 |
| 6,307,290 | B1 | | 10/2001 | Scarsdale | |
| 6,379,127 | B1 | * | 4/2002 | Andrews et al. | 417/423.11 |
| 6,422,822 | B1 | * | 7/2002 | Holmes | 417/9 |
| 6,602,059 | B1 | | 8/2003 | Howell et al. | |
| 6,666,664 | B2 | * | 12/2003 | Gross | 417/423.3 |
| 2003/0053919 | A1 | * | 3/2003 | Wu | 417/423.11 |

FOREIGN PATENT DOCUMENTS

| | | | |
|---|---|---|---|
| DE | 1453725 | A1 | 3/1969 |
| DE | 29514832 | U1 | 1/1996 |
| EP | 0554803 | A1 | 8/1993 |
| WO | WO 2007/075781 | A2 | 5/2007 |

* cited by examiner

*Primary Examiner*—Charles G Freay
*Assistant Examiner*—Alexander B Comley
(74) *Attorney, Agent, or Firm*—Bracewell & Giuliani LLP

(57) ABSTRACT

A seal section for location between a submersible rotary pump and motor has a primary mechanical seal and a secondary oil seal at the pump end of the seal section. The mechanical seal has rigid seal faces that slide in engagement with each other. The secondary seal has an inner portion that seals against the shaft of the seal section and an outer portion that seals against the housing. The seal section has a pressure equalizing device for equalizing pressure of motor lubricant with well bore pressure.

14 Claims, 2 Drawing Sheets

SEAL SECTION OIL SEAL FOR SUBMERSIBLE PUMP ASSEMBLY

FIELD OF THE INVENTION

This invention relates in general to submersible well pump assemblies, and in particular to a seal section located between the motor and the pump for equalizing the pressure of lubricant within the motor with well bore pressure.

BACKGROUND OF THE INVENTION

A typical submersible well pump assembly of the type concerned herein has an electrical motor that is connected to a centrifugal pump by a seal section. The motor is filled with a dielectric lubricant for lubricating bearings within. The seal section has a pressure equalizing device, which may be a bladder or a U-tube arrangement, for equalizing the pressure of the lubricant in the motor with the well bore fluid on the exterior.

The seal section has a shaft that couples to the motor shaft on one end and to the pump shaft on the other end. A mechanical seal between the housing of the seal section and the shaft reduces encroachment of well bore fluid into contact with the lubricant in the seal section and motor. The mechanical seal typically has rigid faces that are biased toward and rotated in sliding engagement with each other. The rotating component of the mechanical seal is attached to the shaft for rotation therewith. The stationary component is attached to the housing. The sliding seal faces are exposed to well bore fluid on one side and lubricant on the other side. Mechanical seal faces of this nature must remain wet in order to work, therefore they are designed to leak small amounts. Even though the leakage rate is very small, well fluid will ingress into the motor over time and may cause a failure.

One way to prolong well fluid entry into the motor is to provide multiple seal sections, each of which contains at least one mechanical seal. This arrangement adds cost and additional length to the equipment.

SUMMARY OF THE INVENTION

The seal section of this invention has a housing located between the pump and the motor, the housing having a pump end and a motor end. A shaft extends through the housing for causing the motor to drive the pump. A primary seal is located at the primary end of the housing. The primary seal has a rotary seal member mounted to the shaft for rotation therewith and in engagement with a stationary seal member stationarily mounted to the housing around the shaft. A secondary seal is located at the pump end of the housing on a motor side of the primary seal. The secondary seal has an outer diameter that frictionally engages the housing and an inner diameter that slidingly engages the shaft.

Preferably, an oil is filled in the space between the secondary and primary seals to provide lubrication for the primary seal. The oil may be a type that is more resistant to emulsifying with water than the motor lubricant or it could be the same as the motor lubricant. The secondary seal separates the fluid between the primary and secondary seals from the motor lubricant in the seal section. The secondary seal may comprise a conventional, inexpensive oil seal.

DETAILED DESCRIPTION OF THE EMBODIMENT

Figure 1:
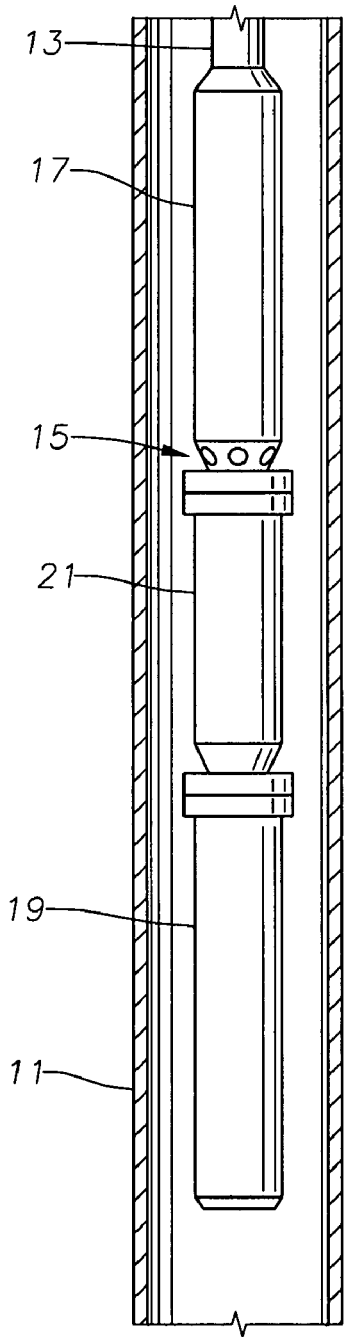
FIG. 1 is a side elevational view of a submersible pump assembly shown schematically within a well bore.

Referring to FIG. 1, the well has a casing 11 that has perforations for entry of well fluid. A string of production tubing 13 extends into the well. An electrical submersible pump assembly 15 is secured to tubing 13 and suspended therefrom.

Electrical submersible pump assembly 15 includes a rotary pump 17 that in the embodiment shown, comprises a centrifugal pump having a plurality of stages. Each stage has a rotating impeller and a stationary diffuser (not shown). Alternately, pump 17 could be another type, such as a progressing cavity pump. In a progressing cavity pump, a helical rotor rotates within a stationary elastomeric stator having a double helical bore.

Figure 2:
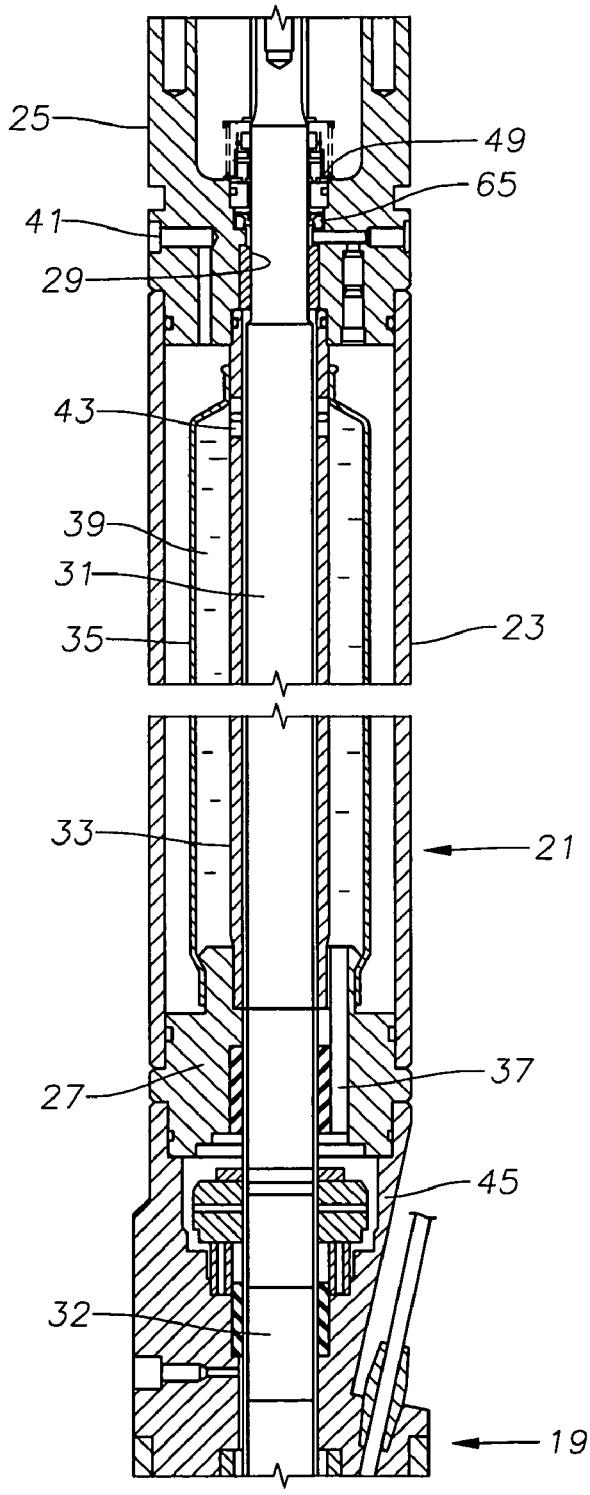
FIG. 2 is a sectional view of the seal section of the submersible pump assembly of FIG. 1, shown enlarged.

Pump 17 is driven by a motor 19, which is typically an AC electrical motor. A seal section 21 extends between pump 17 and motor 19. Seal section 21 serves to equalize the pressure of lubricant contained in motor 19 with the pressure of the well bore fluid. Referring to FIG. 2, seal section 21 has a housing 23. Housing 23 is a tubular member having a pump adapter or end 25 and a motor adapter or end 27. In this embodiment, pump end 25 and motor end 27 are separate tubular members that are secured by threads to housing 23, but they could be integrally formed with housing 23. Pump end 25 connects to pump 17 (FIG. 1), while motor end 27 connects to motor 19 (FIG. 1).

A concentric, axial passage 29 extends through pump end 25, motor end 27 and the interior of housing 23 between pump and motor ends 25, 27. A rotatable shaft 31 extends through passage 29 on the axis of seal section 21. Shaft 31 has a lower end that couples to a motor shaft 32 that is rotated by motor 19.

A tube 33 has a lower end sealed to seal section motor end 27 at passage 29. Tube 33 has an upper end sealed to passage 29 at pump end 25. Shaft 31 extends through tube 33 and has an outer diameter smaller than tube 33, defining a clearance between them.

Seal section 21 has a pressure equalizing device, which in this example, comprises a tubular bladder 35 located within housing 23 around tube 33. Bladder 35 is an elastomeric member that has an upper end sealed to tube 33 just below pump end 25. The lower end of bladder 35 is sealed to seal section motor end 27. A motor lubrication port 37 extends from the interior of bladder 35 into an upper portion of motor 19. Lubricant 39 from motor 19 is able to circulate through motor lubricant port 37 into the interior of bladder 35. A well bore fluid inlet 41 extends through seal section pump end 25 for allowing the entry of well bore fluid into the interior of housing 23 on the exterior of bladder 35. Bladder 35 serves to equalize the pressure lubricant 39 with well bore fluid.

Tube 33 also has ports 43 within it to allow lubricant 39 to flow into the clearances between tube 33 and shaft 31. In this embodiment, the upper end of motor 19 contains a thrust bearing 45 that is lubricated by motor lubricant 39. Motor 19 has additional bearings (not shown) that are also in communication with motor lubricant 39.

Figure 3:
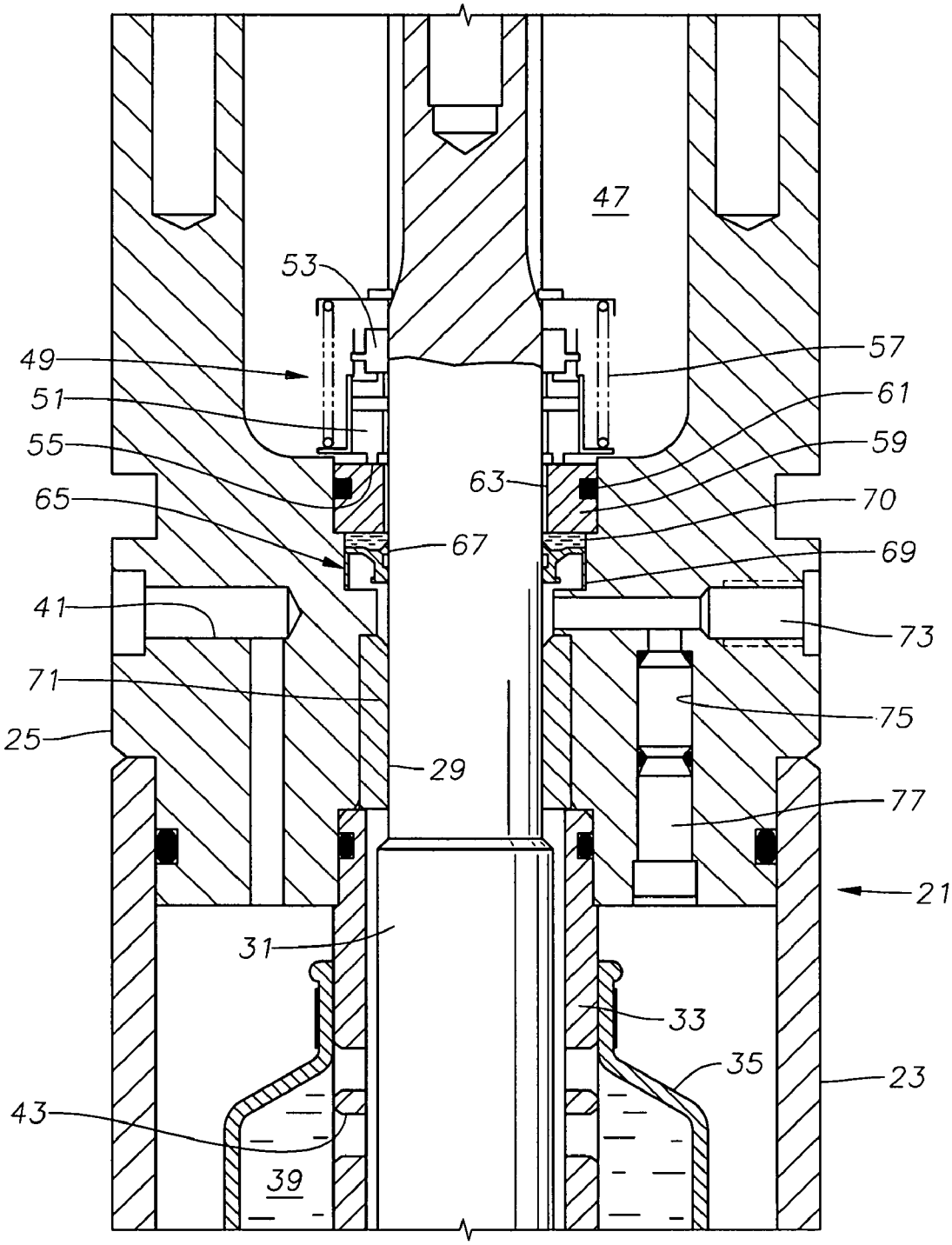
FIG. 3 is a further enlarged view of the upper end portion of the seal section of FIG. 2.

Referring to FIG. 3, in this example, pump end 25 has a central cavity 47 that faces toward pump 17 (FIG. 1) and is in fluid communication with the interior of pump 17. Consequently, well bore fluid will be lubricated within cavity 47. A primary seal 49 seals around shaft 31 in cavity 47 for blocking the entry of well bore fluid into passage 29. Primary seal 49 is a mechanical seal. That term refers herein to a seal that has two rigid seal faces that slidingly engage each other. In the embodiment shown, a rotary seal member 51 rotates in unison with shaft 31. An elastomeric boot 53 seals rotary seal member 51 to shaft 31 and rotates with it. Rotary seal assembly 51 has a rigid seal face 55 that faces downward and comprises a cylindrical protrusion. A spring 57 in cavity 47 urges rotary seal member 51 downward and rotates with shaft 31. Spring 57 comprises a coil spring that encircles rotary seal member 51. The inner diameter of rotary seal member 51 is greater than the diameter of shaft 31 at that point, defining a clearance.

Primary seal assembly 49 has a stationary, rigid seal member 59 with a face that is located in a plane perpendicular to shaft 31. Rotary member seal face 55 slidingly engages the face of stationary seal member 59. Rotary seal member 51 and stationary seal member 59 are made of hard, wear-resistant components, such as tungsten carbide. An elastomeric member 61, such as an O-ring, seals the outer diameter of stationary seal member 59 to housing pump end 25 within passage 29. Stationary seal member 59 has an inner diameter that is larger than the outer diameter of shaft 31 at that point, defining an annular clearance.

A secondary seal 65 is located on the motor side of stationary seal member 59, which is on the opposite side of stationary seal member 59 from rotary seal member 51. Secondary seal 65 may be of a variety of types. Preferably, it is a conventional inexpensive oil seal. In the example shown, secondary seal 65 has an inner seal member 67 that slidingly engages shaft 31 as shaft 31 rotates. Although not shown, shaft 31 could have a bushing or sleeve that rotates with it and is engaged by inner seal member 67. The term "shaft" is used broadly herein to include any such sleeves or bushings mounted to it for rotation therewith. Inner seal member 67 is carried by a carrier 69 that extends outward and has a cylindrical portion that fits tightly within passage 29. Carrier 69 is typically metal and is press-fit into sealing engagement with housing 23 at passage 27. A spring (not shown) within carrier 69 urges inner seal member 67 radially inward against shaft 31. Primary seal 49 and secondary seal 65 define a sealed chamber 63 that extends from secondary seal 65 through the clearances between shaft 31 and stationary member 59 and rotary seal member 51 up within the interior of rubber boot 53.

Preferably, sealed chamber 63 is filled with an oil 70, preferably a fluroinert oil. Oil 70 could be the same as motor lubricant 39, but preferably it is more viscous and more resistant than motor lubricant 39 to emulsifying with water. It is not necessary for oil 70 to have as high of a dielectric characteristic as motor lubricant 39. Unlike motor lubricant 39, oil 79 does not circulate throughout motor 19 (FIG. 1) and seal section 21, thus can be more viscous.

Referring still to FIG. 3, a stationary bushing or bearing 71 is located in passage 29 below secondary seal 65 in this example. A vacuum port 73 extends through pump end 25 below secondary seal 65 for evacuating air from the interior of motor 19 (FIG. 1) prior to introducing motor lubricant 39. Vacuum port 73 communicates with the interior of bladder 35. A fill port (not shown) for introducing motor lubricant 39 is located in a lower portion of motor 19. A vent port 75 joins vacuum port 73 and leads to the exterior of bladder 35 within housing 23. Vent port 75 contains one or more check valves 77 that allow motor lubricant 39 from within bag 35 to vent to the exterior of bag 35 within housing 23 due to thermal expansion, but blocks flow in the opposite direction. After filling, a plug will be placed in vacuum port 73. Also, while evacuating and filling, a plug will be placed in well bore entry port 41. That plug will be removed when running the pump assembly into the well.

In operation, seal section 21 is connected to motor 19 at the surface before running. The chamber between primary and secondary seal assemblies 49, 65 will be filled with oil 70. The operator fills motor 19 and seal section 21 with motor lubricant 39 in a conventional manner. Typically, this is performed by evacuating from vacuum port 73, then introducing motor lubricant 39 from a fill port in the lower portion of motor 19. When completely filled, motor lubricant 39 will be located in bladder 35, within tube 33, and within passage 29 up to secondary seal 65. Oil 70 will be located in sealed chamber 63 on the other side of secondary seal 65. Vacuum port 73 will be plugged and well bore fluid inlet 41 will be open. The operator connects pump 17 to pump end 25 and lowers the assembly into the well, typically on tubing 13 (FIG. 1).

After reaching the proper depth, the operator supplies power over a power cable to motor 19, which rotates shaft 31 to drive pump 17. Well bore fluid, which often has a high water content, will be located in housing 23 on the exterior of bladder 35. Bladder 35 transmits the well bore fluid pressure to motor lubricant 39. Well bore fluid will be also located in cavity 47 (FIG. 3). Primary seal 49 seals against the encroachment of well bore fluid from cavity 47 into passage 29. Rotary seal member 51 rotates with shaft 31, and seal face 55 engages stationary seal member 59. Oil 70 lubricates the seal faces of seal members 51 and 59. Some leakage of well fluid into sealed chamber 63 between primary and secondary seal assemblies 49, 65 occurs, but secondary seal assembly 65 keeps the well bore fluid from entering the interior of bladder 35. Even if secondary seal 65 eventually leaks before pump assembly 15 is pulled, it will have extended the time before well bore fluid enters bladder 35.

The invention has significant advantages. The use of a secondary seal prolongs the entry of well bore fluid into communication with the motor lubricant. The secondary seal may avoid the need for having multiple seal sections. The secondary seal allows the use of a special oil for lubricating the primary seal that is more resistant to demulsifying with water than the motor lubricant.

While the invention has been shown in only one of its forms, it should be apparent to those skilled in the art that it is not so limited but is susceptible to various changes without departing from the scope of the invention. For example, the secondary seal is also applicable to seal sections that utilize a U-tube arrangement as a pressure equalizing device rather than bladders.

The invention claimed is:

1. In a submersible pump assembly having a rotary pump driven by a motor, an improved seal section located between the motor and the pump for equalizing pressure of motor lubricant contained in the motor with well bore fluid pressure on the exterior of the pump assembly, comprising:

a housing located between the pump and motor and having a pump end and a motor end;

a shaft extending through the housing for causing the motor to drive the pump;

a primary seal at the pump end of the housing, the primary seal having a rotary seal member mounted to the shaft for rotation therewith and in engagement with a stationary seal member stationarily mounted to the housing around the shaft;

a non-rotatable secondary seal at the pump end of the housing on a motor end side of the primary seal, the secondary seal having an inner diameter portion in sliding and sealing engagement with the shaft and an outer diameter portion in stationary sealing engagement with the housing; and wherein the primary and secondary seals define a sealed chamber between them that is free of any inlet ports.

2. The pump assembly according to claim 1, further comprising an oil located in the chamber between the primary and secondary seals, the oil being more resistant to emulsifying with water and more viscous than the motor lubricant.

3. The pump assembly according to claim 1, wherein:

the chamber is tilled with a fluroinert oil.

4. The pump assembly according to claim 1, further comprising:

a bladder in the housing through which the shaft extends, the bladder having an interior in fluid communication with the motor lubricant in the motor, the bladder having an exterior in fluid communication with well bore fluid;

an annular passage in the pump end of the housing through which the shaft extends, the annular passage being in fluid communication with the interior of the bladder; and the stationary seal member of the primary seal and the secondary seal being located within the annular passage.

5. The pump assembly according to claim 4, wherein the chamber is scaled from, the interior and the exterior of the bladder.

6. The pump assembly according to claim 1, further comprising:

a coil spring that rotates with the shaft and urges the rotary seal member against the stationary seal member, the spring being located on a side of the stationary seal member opposite the secondary seal member.

7. The pump assembly according to claim 1, wherein the rotary seal member and the stationary seal member of the primary seal have inner diameters greater than the diameter of the shaft, providing clearances for fluid communication.

8. A submersible pump assembly, comprising:

a rotary pump;

a motor containing a lubricant;

a housing located between the pump and motor and having a pump end and a motor end;

a pressure equalizing device within the housing for equalizing pressure of the lubricant in the motor with well bore fluid on the exterior of the housing;

a passage in the pump end of the housing;

a shaft extending through the passage in the housing for causing the motor to drive the pump;

a primary seal at the pump end of the housing, the primary seal having a rotary seal member with a rigid seal face and mounted to the shaft for rotation therewith, the primary seal having a stationary seal member mounted in the passage, the stationary seal member having an inner diameter greater than a diameter of the shaft and a rigid seal face perpendicular to the shaft;

a spring urging the seal face of rotary seal member in a direction toward the motor end of the housing and against the seal face of the stationary seal member;

a non-rotatable secondary seal mounted in the passage at the pump end of the housing on a side of the stationary seal member opposite the spring, the secondary seal having an inner diameter in dynamic sealing contact with the shaft and an outer diameter sealingly engaging the housing; and the secondary seal and the primary seal defining a sealed chamber between them that contains a chamber fluid and is sealed from contact with any other fluids in the interior of the housing.

9. The pump assembly according to claim 8, wherein the chamber fluid in the scaled chamber between the primary arid secondary seals comprises an oil that differs from the lubricant.

10. The pump assembly according to claim 8, wherein the scaled chamber between the primary and secondary seals is filled with an oil that is more viscous than the lubricant contained in the motor.

11. The pump assembly according to claim 8, wherein the pressure equalizing device further comprises:

a bladder in the housing, the bladder having an interior in fluid communication with the lubricant in the motor; and wherein the secondary seal blocks contact of the lubricant in the interior of the bladder with the chamber fluid in the sealed chamber.

12. A submersible pump assembly, comprising:

a housing for location between a pump and a downhole motor, the housing having a pump end and a motor end;

a passage extending through the pump end of the housing;

a shaft extending through the passage in the pump end of the housing for rotating the pump;

a tubular bladder in the housing, the bladder having a pump end opening sealed to the pump end of the housing and a motor end opening sealed to the motor end of the housing, defining an interior for containing motor lubricant, the shaft extending through the pump end opening and the motor end opening;

a well bore port for entry of well bore fluid into the housing around the bladder;

a primary seal having rigid seal faces in sliding engagement with each other as the shaft rotates for sealing between the shaft and the housing at the pump end of the housing;

a non-rotatable secondary seal mounted in the passage at the pump end of the housing on a motor end side of the primary seal, the secondary seal having an inner diameter in sliding and sealing contact with the shaft and an outer diameter in stationary sealing contact with the housing, the secondary seal having a motor side in fluid communication with the interior of the bladder; and the secondary seal and the primary seal defining between them a sealed chamber that is sealed by the secondary seal from entry of the motor lubricant from the interior of the bladder.

13. The pump assembly according to claim 12, wherein the sealed chamber is filled with an oil that is more viscous and more resistant to emulsifying with water than the motor lubricant, and wherein the secondary seal prevents the lubricant in the interior of the bladder from contact the oil in the sealed chamber.

14. The pump assembly according to claim 12, wherein the primary seal comprises a coil spring that is located exterior of the sealed chamber for urging the rigid seal faces into engagement with each other.

* * * * *

UNITED STATES PATENT AND TRADEMARK OFFICE

CERTIFICATE OF CORRECTION

PATENT NO. : 7,665,975 B2
APPLICATION NO. : 11/312624
DATED : February 23, 2010
INVENTOR(S) : Larry J. Parmeter et al.

It is certified that error appears in the above-identified patent and that said Letters Patent is hereby corrected as shown below:

Column 2, line 57, insert --of-- after "pressure"

Signed and Sealed this

Twenty-third Day of November, 2010

David J. Kappos

David J. Kappos
*Director of the United States Patent and Trademark Office*